US012317984B2

(12) United States Patent
Reeder et al.

(10) Patent No.: US 12,317,984 B2
(45) Date of Patent: Jun. 3, 2025

(54) ACTUATING NAIL FILE ASSEMBLY AND METHOD

(71) Applicants: James Scott Reeder, Frisco, TX (US); Grant H. Reeder, Frisco, TX (US); Rachel K. Reeder, Frisco, TX (US)

(72) Inventors: James Scott Reeder, Frisco, TX (US); Grant H. Reeder, Frisco, TX (US); Rachel K. Reeder, Frisco, TX (US)

( * ) Notice: Subject to any disclaimer, the term of this patent is extended or adjusted under 35 U.S.C. 154(b) by 869 days.

(21) Appl. No.: 17/296,047

(22) PCT Filed: May 30, 2019

(86) PCT No.: PCT/US2019/034714
§ 371 (c)(1),
(2) Date: May 21, 2021

(87) PCT Pub. No.: WO2019/232252
PCT Pub. Date: Dec. 5, 2019

(65) Prior Publication Data

US 2022/0125178 A1 Apr. 28, 2022

Related U.S. Application Data

(60) Provisional application No. 62/678,057, filed on May 30, 2018.

(51) Int. Cl.

| | |
|---|---|
| ***A45D 29/18*** | (2006.01) |
| ***A45D 29/05*** | (2006.01) |
| *A45D 29/04* | (2006.01) |

(52) U.S. Cl.
CPC ..... *A45D 29/05* (2013.01); *A45D 2029/045* (2013.01)

(58) Field of Classification Search
CPC ..... A45D 29/04; A45D 29/05; A45D 29/06; A45D 29/11; A45D 29/14
See application file for complete search history.

(56) References Cited

U.S. PATENT DOCUMENTS

| | | | | |
|---|---|---|---|---|
| 4,667,447 A * | 5/1987 | Barton | B24D 15/023 | 451/523 |
| 5,125,422 A * | 6/1992 | Cheung | A45D 29/14 | 132/73.6 |
| 7,428,881 B2 * | 9/2008 | Drelinger | A45D 29/05 | 119/608 |

(Continued)

*Primary Examiner* — Rachel R Steitz
(74) *Attorney, Agent, or Firm* — Law Office of Jeff Williams PLLC; J. Oliver Williams

(57) ABSTRACT

The actuating nail file assembly includes a housing, a controller, a circuit board, a powertrain, a slider, a head, and a power supply. The assembly is configured to selectively induce actuation of the head in one or more directions. The head is configured to engage a nail of a user, such as fingernail or toenail, and work a surface or edge of the nail to a desired condition. The head may be configured to file the nail by containing an abrasive surface configured to removed portions of the nail. Alternatively, the head may be configured to polish the nail by containing a polishing surface texture. The controller regulates the operation of the powertrain. The powertrain selectively induces radial and linear movement of the head in a plurality of directions so as to repetitively alternate between at least two opposing directions.

18 Claims, 6 Drawing Sheets

(56) References Cited

U.S. PATENT DOCUMENTS

| | | | | |
|---|---|---|---|---|
| 2009/0211590 | A1* | 8/2009 | Sarway | A45D 29/05<br>132/73.6 |
| 2011/0226269 | A1* | 9/2011 | Routhier | A45D 29/05<br>132/73.6 |

* cited by examiner

ACTUATING NAIL FILE ASSEMBLY AND METHOD

TECHNICAL FIELD

The present application relates generally to an assembly for the treatment of fingernails and toenails, and in particular to an assembly that actuates a file across a surface of the nail to speedily file and polish the nail with minimal effort.

DESCRIPTION OF THE PRIOR ART

Nail care for fingers and toes is an ever increasing interest of society. Currently, standard tools for nail maintenance have included clippers, manual files, and electric files. Each of these have disadvantages. For example, clippers require filing after use and are very dangerous with the young and elderly. Misuse of clippers often result in cutting too short and/or the production of painful "hangnails". Manual files are used to smooth cut edges of the clippers but are often slow and require a level of expertise to do correctly. Electric files come in various forms from "dremel" style, linear, and rotary. These all require a level of skill to use adequately.

Although great strides have been made with respect to the maintenance of fingernails and toenails, considerable shortcomings remain. A new device is needed to provide a safe, consistent method of filing, polishing and shaping fingernails and toenails for all ages.

SUMMARY OF THE INVENTION

It is an object of the present application to provide an actuating nail file assembly for the polishing and filing of nails. The assembly is configured to induce an actuating head that repeatedly moves back and forth in designated directions. The head is applied to the nail when activated. Pressure of the nail is applied to the head. The surface of the head is textured to accomplish one or more purposes, such as polishing or filing. The assembly can be turned on and off as desired. A power supply is used to provide electrical energy to induce movement of the head.

One object of the present application is to provide a detachable head. The head may be detached and substituted or interchanged with another head. This may occur at any time or when the textured surface loses its effect. The use of a detachable head also allows for the head to be manufactured with different contours or shapes. The radius curvature of the head may be enlarged or shrunk to fit different nail profiles. Additionally, the width may be modified. Any surface characteristic may be modified to customize the fit and shape of the head to correspond to a desired nail profile.

In one embodiment, the head is releasably coupled via a mechanical press-fit coupling. In another embodiment, the head is coupled via a magnetic coupling.

A further object of the present assembly is to permit movement of the head in multiple directions. The head may be moved in a linear movement. Likewise, the head may alternatively be moved in a radial movement. Additionally, the head may be moved in alternating linear and radial movements. The user is able to select the mode of the assembly which corresponds to the type of movement of the head.

Furthermore, an object of the assembly is to provide functional control to the user to adjust and/or regulate the speed of the head and its movement.

The more important features of the assembly have thus been outlined in order that the more detailed description that follows may be better understood and to ensure that the present contribution to the art is appreciated. Additional features of the system will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the system in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present assembly. It is important, therefore, that the claims be regarded as including such equivalent constructions insofar as they do not depart from the spirit and scope of the present assembly.

BRIEF DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
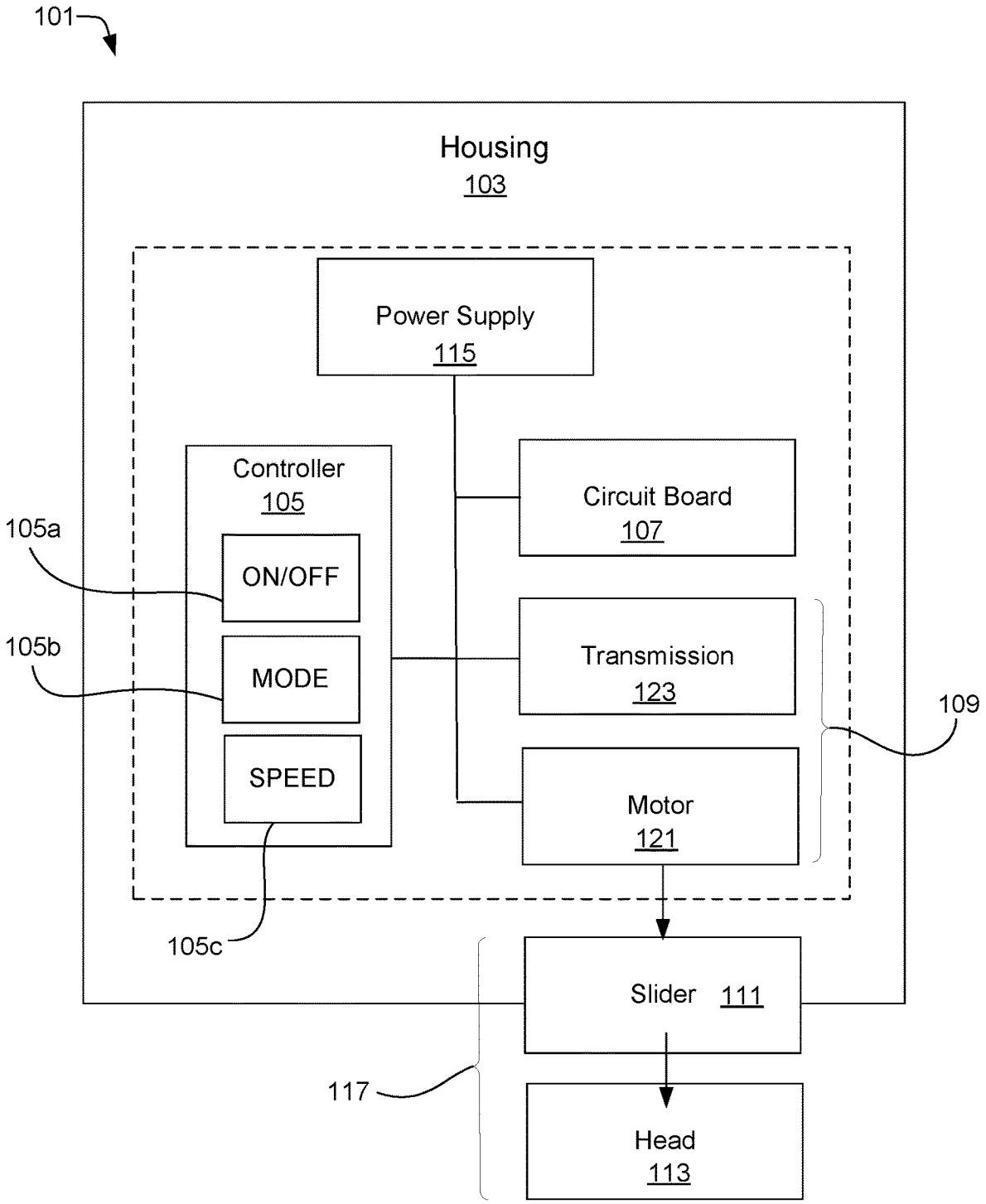
FIG. 1 is a general schematic of an actuating nail file assembly according to an embodiment of the present application.

While the assembly of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with standard tools for the care of nails. Specifically, the actuating nail filing assembly of the present application is configured to provide a safe, consistent method of filing, polishing and shaping fingernails and toenails for all ages, from infants to the elderly. A smooth and consistent filing and polishing is achieved through the generation of at least one of a radial motion and a linear motion relative to the nail. No skill is required for any of these operations beyond the initiating of the actuating nail filing assembly and the application of pressure by the nail on the file in motion. These and other unique features of the assembly are discussed below and illustrated in the accompanying drawings.

The assembly will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The embodiments and method of the present application is illustrated in the associated drawings. The assembly and method of the present application includes a main body housing used to house an assortment of hardware. Housed within the housing is a controller, a circuit board, a power supply, a powertrain, and a slider. A releasable head is coupled to the slider and is external to the housing. It is understood that the head may be wholly or partially internal within the housing in selected embodiments. The controller regulates operation of the slider and powertrain. The head is interchangeable and releasably couples to the slider. The power supply provides power which is regulated by the user through the controller. The file assembly is in communication with the power supply through a transmission/motor, or powertrain, which induces movement of the head in linear and/or radial movements. Additional features and functions are illustrated and discussed below.

Referring now to the Figures wherein like reference characters identify corresponding or similar elements in form and function throughout the several views. The following Figures describe the assembly of the present application and its associated features. With reference now to the Figures, an embodiment of the valve assembly and method of use are herein described. It should be noted that the articles "a", "an", and "the", as used in this specification, include plural referents unless the content clearly dictates otherwise.

Referring now to FIG. 1 in the drawings, an exemplary schematic of an actuating nail file assembly according to the present application is illustrated. Actuating nail file assembly 101 includes a housing 103, a controller 105, a circuit board 107, a powertrain 109, a slider 111, a head 113, and a power supply 115. Assembly 101 is configured to selectively induce actuation of head 113 in one or more directions. Head 113 is configured to engage a nail of a user, such as fingernail or toenail, and work a surface or edge of the nail to a desired condition. The head may be configured to file the nail by containing an abrasive surface configured to removed portions of the nail. Alternatively, the head 113 may be configured to polish the nail by containing a polishing surface texture. FIGS. 2-9 are provided to illustrate an exemplary embodiment of assembly 101. It is understood that the particular functional size, shape, and configuration may be modified according to design constraints.

Figure 2:
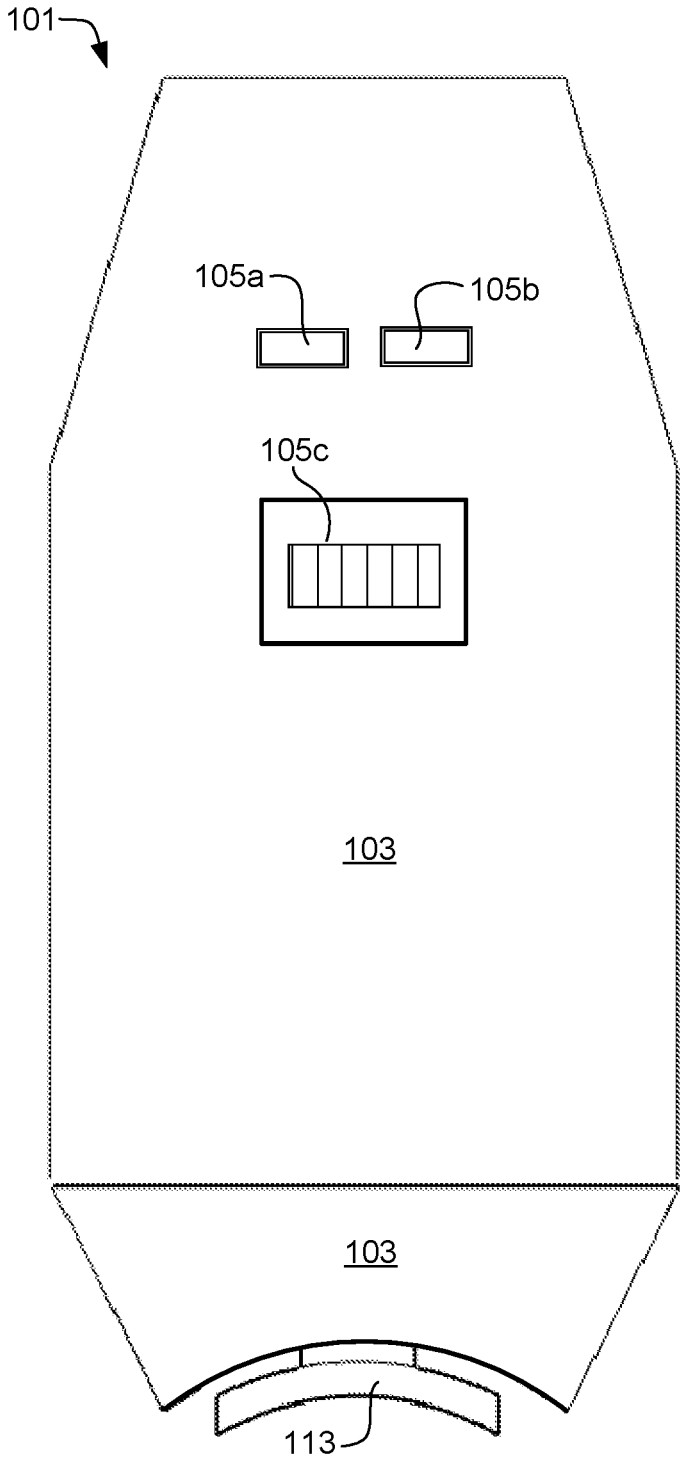
FIG. 2 is a front view of an exemplary embodiment of the assembly of FIG. 1.
Figure 3:
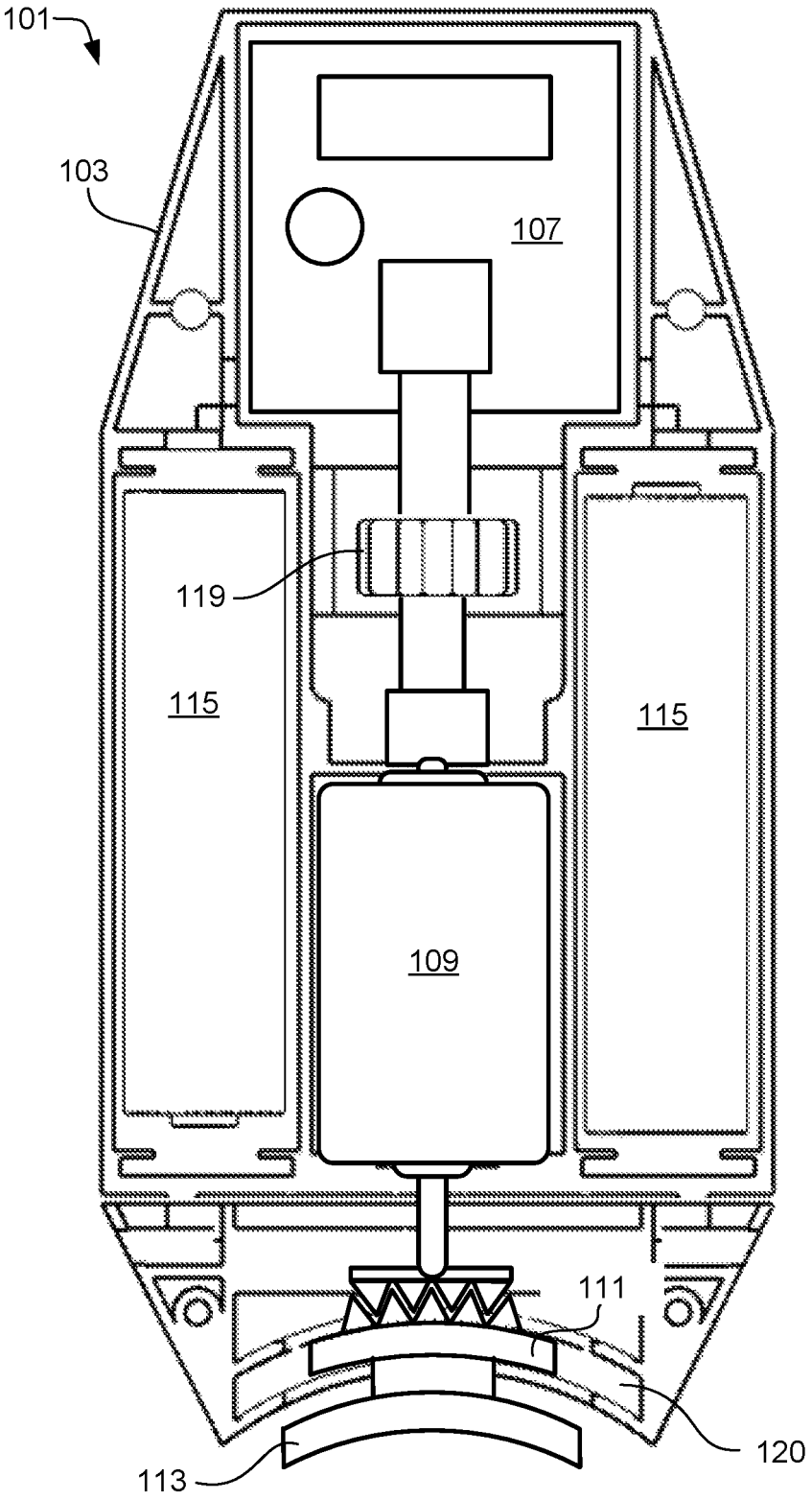
FIG. 3 is an internal front view of the assembly of FIG. 2.

Referring now also to FIGS. 2 and 3 in the drawings, front views of an exemplary embodiment of assembly 101 are illustrated. Assembly 101 includes housing 103, power supply 115, and powertrain 109. Also included is controller 105 for regulating the operation of powertrain 109. The file assembly 117 includes slider 111 and head 113. These are moved through operation of powertrain 109, which selectively induces movement of the file assembly in a plurality of directions such that the file assembly is configured to repetitively alternate between at least two opposing directions.

In particular with FIG. 3, assembly 101 is shown externally wherein housing 103 is encasing a majority of the prior discussed components. Housing 103 is a hardened case designed to provide protection to the components and to provide a place to nest the components together in an orderly and safe manner. It is understood that housing 103 may be made from various types of materials and may have any shape. Design constraints may influence the ergonomics, functions, and characteristics of housing 103 in different applications of use.

Controller 105 is provided for interaction with a user. Controller 105 includes inputs 105*a-c*. Inputs 105*a-c* may be buttons, switches, gears, dials, and the like. Input 105*a* is used to turn on and off assembly 101. This acts to regulate power via power supply 115 to powertrain 109 and/or circuit board 107. Power supply 115 may be a battery or other stored power source (direct current) or may be configured to receive alternating current through a plug-in interface to the electrical grid or generator. In such an embodiment as the latter, power supply 115 may be located externally to housing 103.

Input 105*b* is configured to regulate the mode of assembly 101. The mode of assembly 101 has reference to the type of movement induced upon file assembly 117. Assembly 101 is configured to actuate file assembly 117 between at least one of a linear movement and/or a radial movement. A first mode may allow a linear movement of file assembly 117. A second mode may induce a radial movement of file assembly 117. A third mode may induce both a linear movement and a radial movement in a defined sequence. Selection between the various modes may be made through a switch input or through sequential depressions of input 105*b* for example. Board 107 is configured to monitor and regulate the interactions of controller 105 and powertrain 109. Circuit board 107 is in communication with the power supply 115 and the powertrain 109. The circuit board 107 is configured to automatically regulate operation of the powertrain 109, so as to control at least one of speed of movement of the file assembly 117 and mode selection.

Additionally, controller 105 may include input 105*c* configured to regulate the speed of movement of file assembly 117. In this example in FIGS. 2 and 3, input 105*c* is a rotating dial with teeth configured to engage a gear 119. Gear 119 engages powertrain 109 to speed regulate the operation of motor 121. Gear 119 may engage either one of motor 121 and/or transmission 123 of powertrain 109. It is understood that any number of methods may be employed to regulate speed and/or change modes. The methods described herein are not intended to be limiting and serve as one manner of accomplishing such task.

It should be understood that board 107 may be configured to store one or more filing or movement profiles. This could allow for a greater selection of motions for the user to choose from. Board 107 may also permit functions such as time delay, auto speed variation, sleep mode when left on and so forth.

From FIG. 3 it is clear to see how slider 111 is located within a slot 120 within housing 103. The slot is shaped in the form of an arc. Movement of slider 111 laterally as viewed in FIG. 3 would induce a radial motion as slider 111 traverses slot 120. More detail about the motion of file assembly 117 will be provided in discussion with subsequent Figures.

Figure 4:
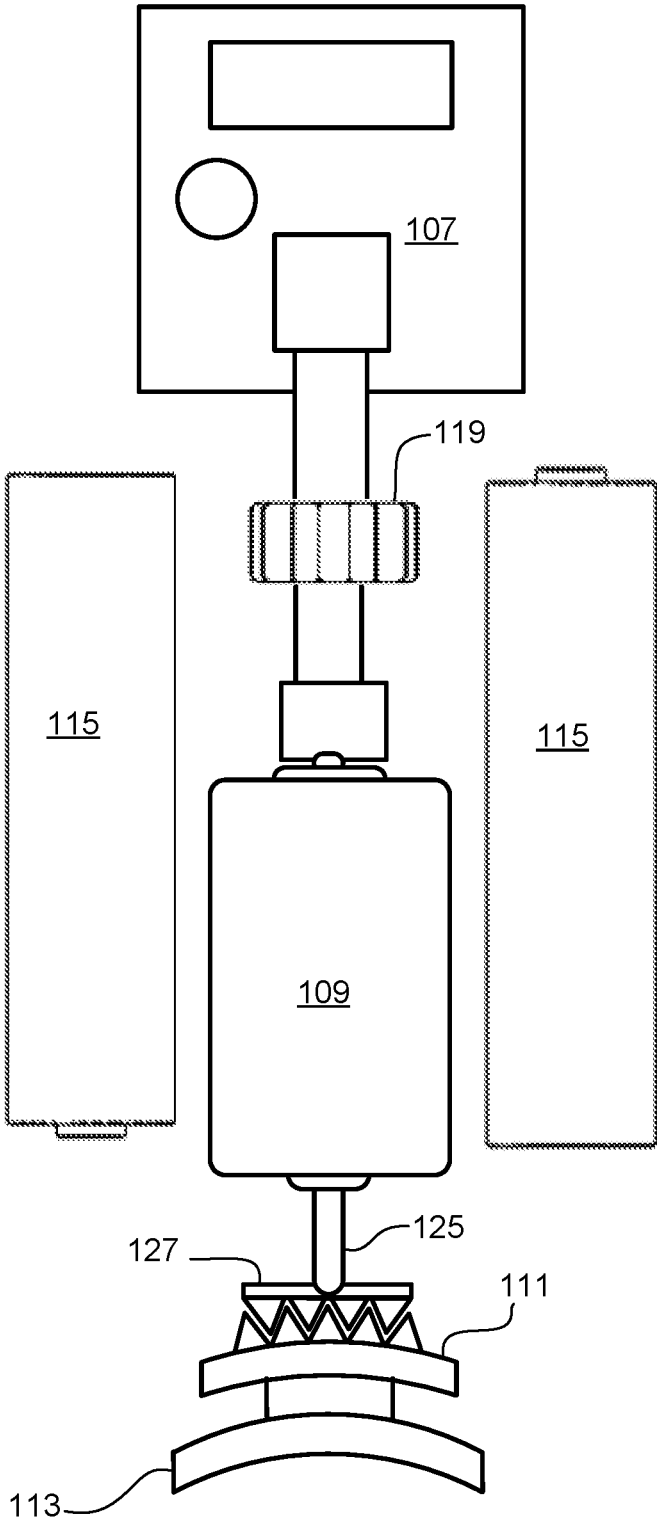
FIG. 4 is an alternate front view of the assembly of FIG. 3.

Referring now also to FIG. 4 in the drawings, a front view of the components within assembly 101 are illustrated. In this view, housing 103 is removed to add in clarity of the components described above. Although not shown is the wiring for passing electrical current from power supply 115 to controller 105, powertrain 109, and/or board 107, such is to be interpreted as being present. More clearly seen in FIG. 4 is the presence of stem 125 and coupler 127. Stem 125 extends from powertrain 109 and engages a rear portion of coupler 127.

Figure 5:
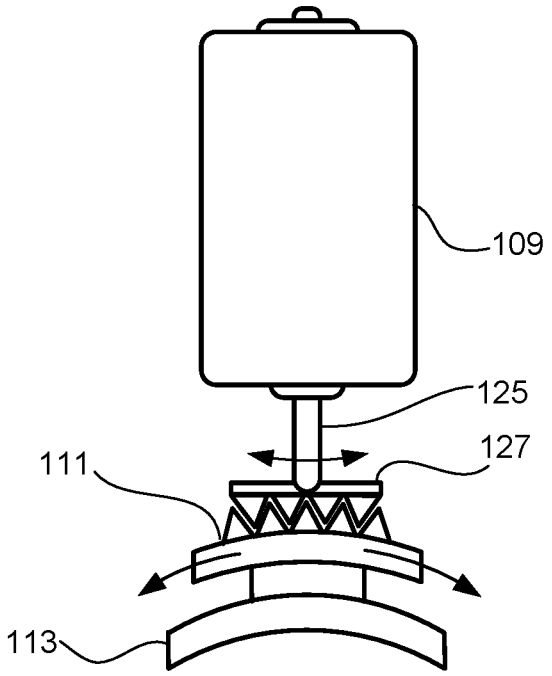
FIG. 5 is an enlarged front view of a powertrain in the assembly of FIGS. 3 and 4.

Referring now also to FIG. 5 in the drawings, an enlarged front view of powertrain 109 is illustrated in communication with file assembly 117. Powertrain 109 induces movement on head 113 by actuating head 113 in one or more sets of direction (i.e. radial and/or linear). One manner of accomplishing this is the use of stem 125. Stem 125 extends away from powertrain 109 and couples to slider 111. As noted above, slider 111 translates within slot 120. Powertrain 109 is configured to move stem to induce movement of file assembly 117. Movement of stem 125 may occur through pivoting it about an axis point, such that the distal tip of stem 125 makes a radial arc of motion. Additionally, powertrain 109 may induce an linear movement upon stem 125. The linear motion may be inward/outward to powertrain 109, side to side, or up and down. The distal tip of stem 125 remaining linear during motion. Any combination of linear and radial may also be done.

Where slider 111 is located in a track of housing 103, such as with slot 120, some degrees of freedom may be limited. However, other embodiments may limit the size or use of slot 120. In FIG. 5, arrows are used to show motion of stem 125 and slider 111. The radial movement of slider 111 coincides with the shape of slot 120.

Also of note, coupler 127 and stem 125 may be pivotally coupled together or may be firmly fixed in relation to one another. The method or type of coupling may be determined partially upon the type of motion desired of file assembly 117 and the type of motion of stem 125.

Slider 111 engages with coupler 127. The manner of coupling is one which permits the desired types of movement. It is ideally desired that slider 111 is releasably coupled to coupler 127. In FIG. 5, coupler 127 and slider 111 are shown to have interlocking teeth that nestle together. In such an embodiment it would be difficult to induce an in and out movement of stem 125 and file assembly 117, however other types of engagement are possible and such depiction is not limiting.

Figure 6:
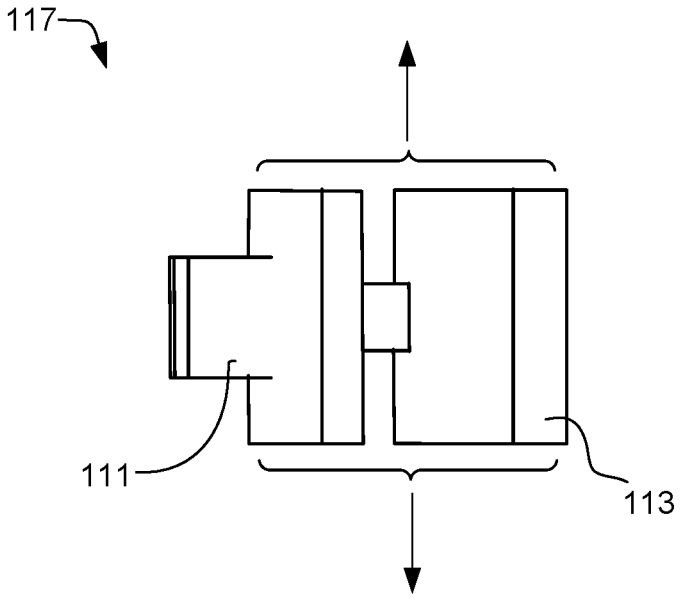
FIG. 6 is an enlarged side view of a slider and head in the assembly of FIG. 5.

Referring now also to FIG. 6 in the drawings, an enlarged side view of file assembly 117 is illustrated. Head 113 and slider 111 are shown from the side and arrows are provided to show possible motion or movement of assembly 117 in an up and down direction.

Figure 7:
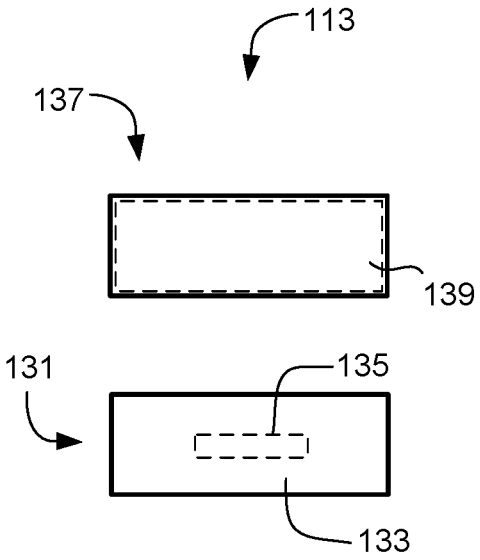
FIG. 7 is a top and bottom view of the head in the assembly of FIG. 5.

Referring now also to FIG. 7 in the drawings, a top and bottom view of head 113 is provided. Top view 131 illustrates the back surface 133 of head 113. Back surface 133 is adjacent to and facing slider 111. Bottom view 137 illustrates the front surface or textured surface 139 of head 113. Surface 139 is opposite from surface 133 and faces away from slider 111. Textured surface 139 has a texture or surface treatment different from that of other surfaces on head 113. Textured surface 139 may be configured to polish or be abrasive to remove material. Textured surface 139 may be formed from the application of a material that is releasably adhered to head 113. In other embodiments, such material may not be removable.

Figure 8:
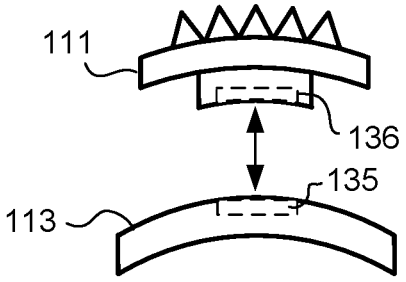
FIG. 8 is a front view of the slider and head of FIG. 5 realeasably coupled.

Referring now also to FIG. 8 in the drawings, a front view of file assembly 117 is illustrated. In this Figure, file assembly 117 is depicted as being detachable. Head 113 is removable from slider 111. The removable nature allows head 113 to be disposable. This is useful in instances where textured surface 139 is not removable, as a worn surface would make head 113 less effective and inefficient and therefore require the replacement of the entire head 113. Of note is that head 113 and slider 111 are detachable from one another which lends itself to immense interchangeable possibilities. The ability to provide interchangeablility can occur through various mechanical and/or electrical attachment methods. For example, an interference fit (i.e. press-fit) may be used between slider 111 and head 113. Likewise, a non-pressing application of attachment may also be used. As seen in FIGS. 7 and 8, a magnet 135 and 136 may be used to provide a magnetic attraction between slider 111 and head 113. One or more magnets may be used. This includes the need for only one magnet to be used between slider 111 and head 113.

Figure 9:
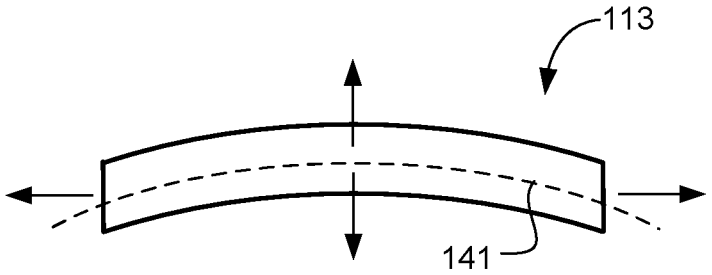
FIG. 9 is a front view of the head of FIGS. 3 and 4.

Referring now also to FIG. 9 in the drawings, an enlarged front view of head 113 is provided. The contour of head 113 is designed to provide a particular nail profile to a user. The textured surface 139 is what engages the nail of the user. As nails are typically rounded at the tip of a finger or toe, the textured surface 139 would generally be concave defined through a curved axis 141 having a particular radius. The interchangeability of heads 113 allows for a user to select from various different textured surface 139 profiles. The arrows in FIG. 9 indicate various types of modifications which may be made to affect the profile of surface 139. The arc of axis 141 may flatten or tighten up to amplify the curve with a smaller radius. It should be noted that the curve of surface 139 may be seen in both horizontal and vertical directions. Additionally, the width and/or length of surface 139 may be adjusted to be shorter or longer between heads. This function allows the user to change not only the textured surface type, but also the profile of the surface 139.

It is noted that the exact shape of slider 111 and head 113 are not limited to that depicted or described. The location of magnets 135 and 136 may be at any location on each item. Additionally, some embodiments may permit some rotation or relative movement between slider 111 and head 113, such as the ability of head 113 to pivot relative to slider 111.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

The invention claimed is:

1. An actuating nail file assembly, comprising:

a housing;

a power supply;

a powertrain in communication with the power supply, the powertrain configured to output an alternating radial and linear movement, the powertrain having a stem and a coupler, the stem extending between the powertrain and the coupler, the powertrain configured to selectively pivot the stem so as to induce a radial arc of motion;

a slider coupled to the powertrain through the coupler so as to receive the alternating linear and radial arc movement, the slider configured to radially move within a slot within the housing in response to the alternating linear and radial arc movement of the powertrain;

a head coupled to the slider external to the housing, the head configured to move radially with the slider; and a controller configured to regulate the operation of the powertrain;

wherein the file assembly is configured to repetitively alternate between at least two opposing directions.

2. The assembly of claim 1, wherein the power supply is a battery.

3. The assembly of claim 1, wherein the power supply is an alternating current.

4. The assembly of claim 1, wherein the housing encapsulates at least the power supply and the powertrain.

5. The assembly of claim 1, wherein the head includes a curved textured surface.

6. The assembly of claim 5, wherein the textured surface is interchangeable.

7. The assembly of claim 5, wherein the textured surface is at least one of a polishing surface and an abrasive surface.

8. The assembly of claim 1, wherein the head releasably couples to the slider through a mechanical press-fit connection.

9. The assembly of claim 1, wherein the head releasably couples to the slider via a magnet.

10. The assembly of claim 1, wherein the head is disposable.

11. The assembly of claim 1, wherein the head is interchangeable.

12. The assembly of claim 1, wherein the controller is configured to regulate the speed of movement of the slider.

13. The assembly of claim 1, wherein the powertrain is configured to operate between one or more modes, the one or more modes regulate the direction of movement of the slider.

14. The assembly of claim 13, wherein the controller permits election of the mode of the powertrain.

15. The assembly of claim 13, further comprising:

a circuit board in communication with the power supply and the powertrain, the circuit board configured to automatically regulate operation of the powertrain, so as to control at least one of speed of movement of the slider and mode selection.

16. The assembly of claim 1, wherein the slider is configured to move in a linear movement.

17. The assembly of claim 1, wherein the slider is configured to move in a radial movement.

18. The assembly of claim 1, wherein the slider is configured to move in both a linear movement and a radial movement.

* * * * *